US005421315A

United States Patent [19]

Miller

[11] Patent Number: 5,421,315

[45] Date of Patent: Jun. 6, 1995

[54] CROSSHAIR BOW SIGHT

[76] Inventor: Michael R. Miller, Rte. 2, Box 1701, Vinemont, Ala. 35179

[21] Appl. No.: 111,533

[22] Filed: Aug. 25, 1993

[51] Int. Cl.[6] ..... F41B 5/14

[52] U.S. Cl. ..... 124/87; 124/80

[58] Field of Search ..... 124/87, 86, 80; 33/265

[56] References Cited

U.S. PATENT DOCUMENTS

| | | | |
|---|---|---|---|
| 2,332,080 | 10/1943 | Howe | 124/87 |
| 2,654,152 | 10/1953 | La Yire | 33/265 |
| 3,136,063 | 6/1964 | Stebbins | 124/87 |
| 3,475,820 | 11/1969 | Kernan | 33/265 |
| 3,670,422 | 6/1972 | Stebbbins et al. | 33/265 |
| 4,136,462 | 1/1979 | Topel | 33/265 |
| 4,910,874 | 3/1990 | Busch | 124/87 |
| 5,050,576 | 9/1991 | Larson | 124/87 |
| 5,103,568 | 4/1992 | Canoy | 124/87 |

*Primary Examiner*—Anthony Knight

[57] ABSTRACT

An adjustable crosshair bow sight, comprised of a frame which forms an apperture or sighting window. The window is bisected by a vertical crosshair, and the horizontal crosshair pins are inserted into the frame through holes in one of the sides of the frame. These holes are arranged in rows which are out of vertical registration with each other to provide a fine adjustment of the pins. The ends of the pins are held in place by corresponding holes in the opposite side of the frame, and the entire pin is held within the frame by a retaining plate which attaches to the entrance wall. The use of holes to insert and hold the pins allows not only a fine adjustment, but an easy method for resetting the pins to a preferred sighting position. The holes eliminate the trial and error that would normally be necessary in setting a sight to duplicate a previously used pin position, should an archer choose to change the type of bow or arrow used, or should otherwise encounter a need to change the pin settings.

8 Claims, 3 Drawing Sheets

CROSSHAIR BOW SIGHT

BACKGROUND OF THE INVENTION

1. Field of the Invention

This invention relates in general to archery sighting devices, and in particular, to sighting devices which utilize adjustable or mobile crosshairs to aim at a target.

2. Description of Related Art

For years, archers have struggled with unsatisfactory sighting devices which, although an improvement over instinct shooting, did not fulfill the modern archer's needs. These devices were imprecise, inaccurate, and difficult to adjust under changing shooting conditions. With the advent of powerful compound bows, the accuracy of available sighting devices has decreased further due to the increase in the speed of the arrow. If more force is applied behind an arrow, the arrow travels faster, and a lower trajectory is achieved. Thus, the archer must space the pins much closer together when using such a bow. If the design of a sighting device makes this impossible, the device is useless to a compound bow shooter. In addition, if an archer wishes to change the type of bow or arrow used or compensate for other encountered variables, he needs a method whereby he can set and reset his sight with a minimum of time and effort. This same sight, while being easy to adjust and reset, must also be durable and reliable enough that the settings will not easily shift over time or be easily damaged in the field.

Several inventors have offered devices intended to alleviate one or more of the above-enumerated obstacles, but none of the prior art inventions has comprehensively met the modern archer's needs. The prior art sights which I have found to be closest in concept to the present invention will be referenced in the following discussion:

U.S. Pat. No. 3,136,063 issued to Herve A. Stebbins on Jun. 9, 1964 was the first to allow for a multiplicity of crosshair sights, each of which could be adjusted independently of the others. The sight was limited in that the shooter was required to effectively dismantle the device to change a pin position. Once the plates had been removed, all of the pins were exposed, and thus, were vulnerable to change. In addition, the design made adjustment awkward and clumsy and precluded a closely-spaced positioning of range pins.

The next patent of interest also belonged to Herve A. Stebbins, namely U.S. Pat. No. 3,670,422, issued on Jun. 20, 1972. This device alleviated the need for disassembly and provided a finer adjustment. However, these improvements presented other obstacles. For example, the removal or insertion of pins was difficult and complex. In addition, the sight pins were tedious to adjust, requiring a special tool to be carried at all times. The pins were held in place by set screws which could easily work their way loose, allowing the pins to gradually move downward. Most importantly, the size of the set screws did not allow the pins to be placed closely together as is necessary with the high-speed modern bows.

Another representative patent is illustrated in U.S. Pat. No. 4,136,462 which was issued to Kenneth D. Topel on Jan. 30, 1979. Although this invention also allowed a fine adjustment, it required a separate, bulky mounting mechanism for each horizontal wire, limiting the proximity in which two wires could be placed. The mounting mechanisms were composed of a screw apparatus which could slip and allow the crosshairs to move. These crosshairs were not supported on one end, and this added to their instability.

The most recent crosshair sight is described in the patent issued to Marlow W. Larson on Sep. 24, 1991 and designated U.S. Pat. No. 5,050,576. This device allows for a fine adjustment and a closer placement of sight pins. However, this sight as well uses screws to hold the vertical pin positions. It is well known that screws gradually loosen, and this would permit the pins to move. The pins are secured at one end only, leaving the opposite end free to snag brush during rigorous hunting conditions.

In addition to the aforementioned problems, all of the prior art sights are difficult to resight if a shooter should change the type of bow or arrow used or otherwise need to vary the pin positions. Any time such a change is made, each and every pin must be individually reset. No change in pin position can be made, not even to a previously used position, without using numerous test shots. To be truly effective under modern shooting conditions, a sight must provide for a solution to this and a multitude of other problems.

SUMMARY OF THE INVENTION

An object of the present invention is to provide for a plurality of crosshair sights, the range settings of which can be adjusted independently of one another and independently of any adjustment for windage.

Another object is to provide a device which is characterized by greater reliability of positioning by including a stable method of securing the sight pins so as to reduce or eliminate slippage and warping over time. This should be accomplished in a manner that will also decrease the chances of damage to the sight caused by conditions encountered while hunting.

It is a third object to construct the aforementioned sight in a manner to allow both closely-spaced vertical positioning of the range pins and very fine or minute adjustment of said pins.

A final object of the present sight, is to create a means to easily reset the entire sighting device as the archer encounters varying conditions. The speed of the bow, the weight of the arrow, the proximity of ranges desired, and the individual characteristics of and techniques used by a given shooter all interreact to determine the needed positioning of each sight pin within the device. Therefore, it is desirable to provide a method whereby an archer may quickly and easily reset all crosshairs to a previously used setting with few or no test shots.

The present invention accomplishes these objects by use of a rectangular frame, the interior of which is bisected by a vertical pin. At least two vertical rows of pinpoint holes are drilled completely through the first wall parallel to the vertical pin for the dual purpose of inserting the range pins and supporting one end in place. The two rows of holes are out of vertical registration with each other to allow for a fine adjustment of the vertical positioning of the pins. These two rows are aligned with an identical set of holes which only partially penetrate the opposite wall so as to support the second end and hold the pins rigidly in place perpendicular to the vertical windage pin. The holes run, in straight lines, across the entire vertical dimension of the walls, and sight pins may be inserted into any number of these holes. A plate is used to cover the exterior openings of the holes so as to hold the pins in place within the frame once they are positioned. The wall through which the pins are inserted has two threaded holes to accept fingerscrews which hold the plate against the wall of the frame. The pins are provided with knobs or heads on one end for ease of insertion and removal. The second wall of the frame has two threaded holes drilled through it to accept threaded rods for use in attaching the sight box to the bow. Two nuts, which can be tightened or loosened, are provided on the end of each screw to move the entire frame from right to left and adjust the sight for windage. The use of holes to hold the pins is more stable than the securing mechanisms provided in previous inventions, as well as more durable. In addition, by making note of the hole numbers used for a given bow or a given weight of arrow, an archer can easily reset the sight by merely setting the vertical crosshair and the top range crosshair. If the other pins have been re-inserted in the proper holes, they will be automatically reset.

DETAILED DESCRIPTION OF A PREFERRED EMBODIMENT

Figure 1:
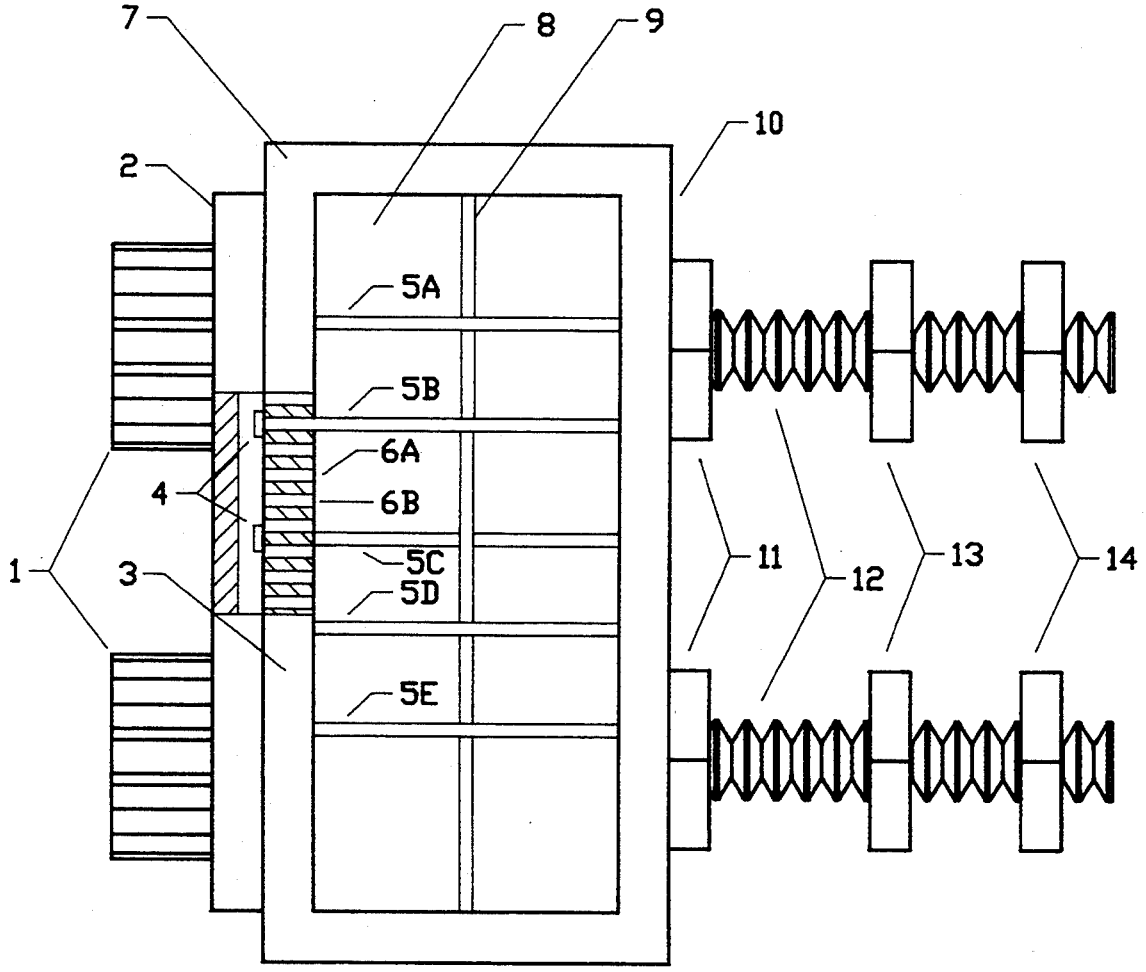
FIG. 1 is a front plan view of the preferred embodiment of the sighting device with a portion being cut away to show a cross section of the interior of the first row of holes and to illustrate two representative pin positions.

As illustrated in FIG. 1, the device is composed of a rigid (preferably rectangular) sight body member 7, with smooth, flat, elongated side members, joined at right angles to form a central opening or aperture 8. This aperture 8 is bisected by a vertical crosshair 9. Each of the horizontal crosshairs 5A–E (number of crosshairs optional) are equipped with a head 4 to provide a surer grip for insertion or removal of the crosshairs 5A–E through the entrance wall 3. The ends of crosshairs 5A–E are supported by holes in the opposite wall 10, and the crosshairs are held securely in place by a retainer plate 2. The retainer plate 2 may be easily removed through the use of two screws 1 (preferably fingerscrews).

The mounting mechanism provided is a simple set of threaded rods 12, which are secured to the sight body 7 by the use of a set of conventional lock nuts 11. As is illustrated in FIG. 2B, two additional sets of lock nuts 13 & 14 are recommended to attach the invention to the bow (not shown) by the use of a conventional sight plate 28. The threaded rods 12 may be used to attach the invention to the bow by inserting them through a clearance slot 29 provided by most such sight plates. One set of lock nuts 13 remains on the inside of the sight plate 28 and is tightened against the plate. Another set of lock nuts 14 is placed on the opposite side of the sight plate 28 and is tightened toward set 13.

As is illustrated by the cut away portion of FIG. 1, the retainer plate 2 is designed to provide clearance for the crosshair heads 4. This is more readily seen by referring to FIG. 2A, specifically the stepped-down portion 15 of the retainer plate 2. The side member holes are of a first diameter and the crosshairs 5A–E are of a diameter that is slightly less than the first diameter. Any number of crosshairs 5A–E may be inserted into a multitude of pinpoint holes which penetrate the entrance wall 3 of the sight body 7. These holes are arranged in two rows 17 & 18 which are out of vertical registration with each other. This provides for close spacing and fine adjustment of the crosshairs (additional rows may be added for even finer adjustment). For example, refer to FIG. 1. Crosshair 5B is shown inserted in a hole of row 18 while crosshair 5C is in a hole of row 17. Crosshair 5C could be moved as close to crosshair 5B as hole 6B of row 18, or even to hole 6A of row 17, without disturbing or moving crosshair 5B.

Figure 2A:
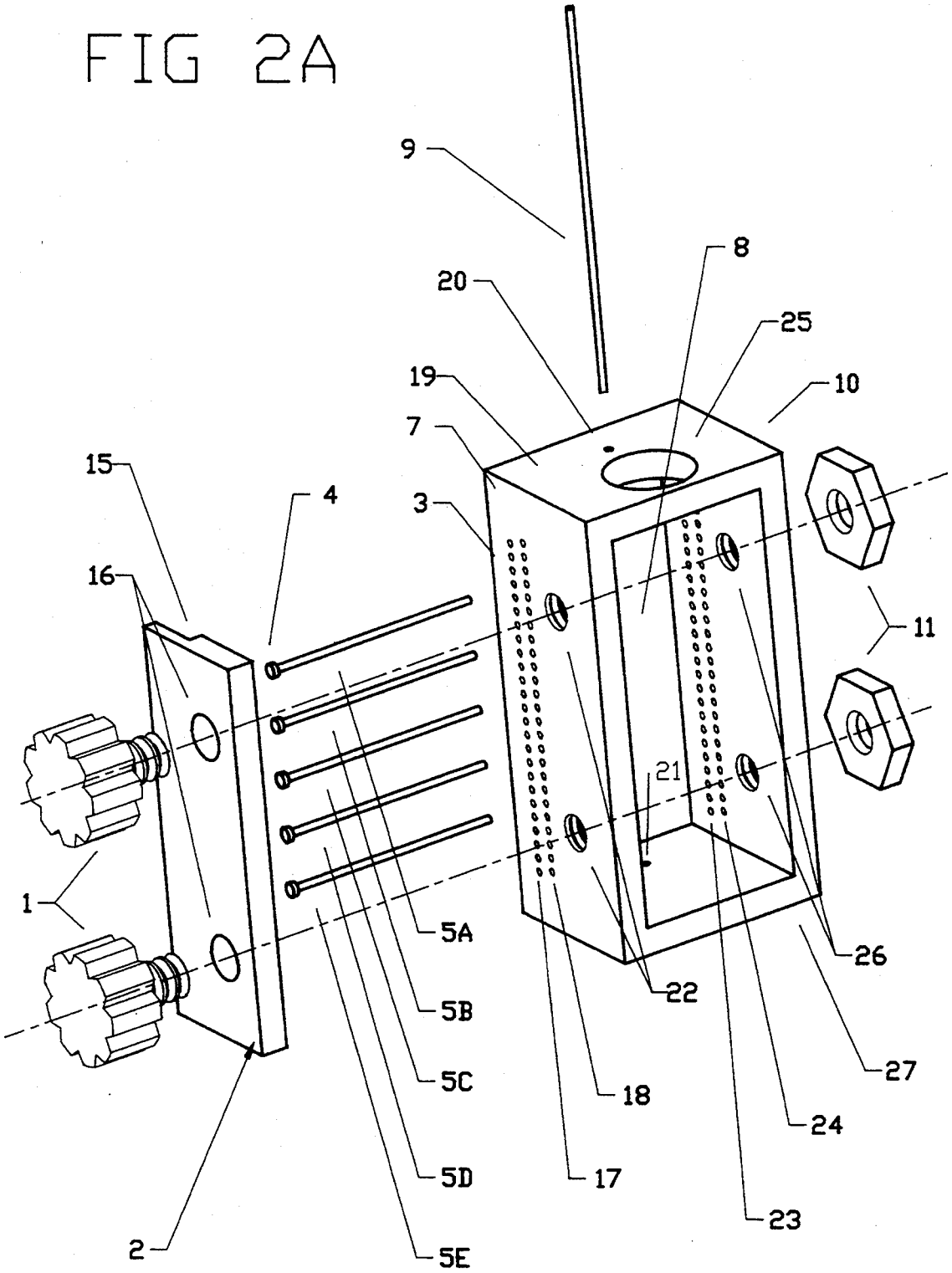
FIGS. 2A and 2B are the two parts of an isometric view, exploded to illustrate the components of a preferred embodiment of the sight and demonstrate one manner in which it may be attached to a bow using a pre-existing sight plate.
Figure 2B:
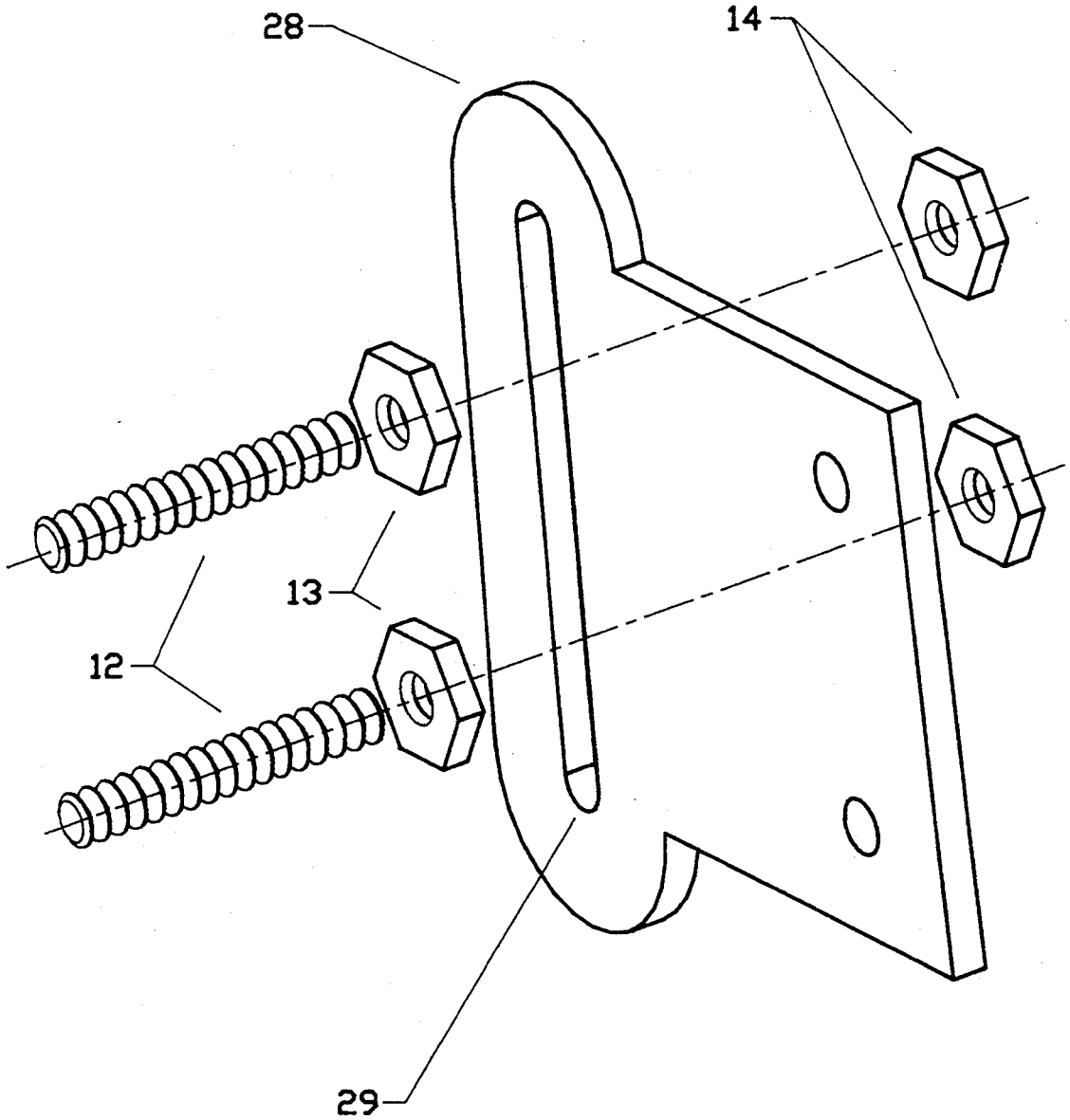

FIGS. 2A–B illustrate a possible assembly of the device including a conventional sight or mounting plate 28. When the invention is assembled, the threaded rods 12 are screwed into the threaded holes 26 in the second wall 10 of the sight body 7. The set of lock nuts 11 are tightened down so as to be flush with second wall 10. The vertical crosshair 9 is inserted through a smooth bore hole 20 in the top 19 of the sight body 7 and the end of crosshair 9 is received by hole 21 which only partially penetrates the material of bottom 27 of the sight body 7. The preferred embodiment is for vertical pin 9 to be secured in its position. There is a smooth bore hole 25 which completely penetrates the top 19 of the sight body 7 to allow light to enter or for mounting an accessory device.

The crosshairs 5A–E may be inserted in any of the holes seen in rows 17 or 18. In the second wall 10, there are two corresponding rows of holes 23 & 24 which do not completely penetrate the material of second wall 10. These holes are designed to receive the ends of the crosshairs 5A–E and to support them. This provides the invention with added durability and reliability by reducing the possibility of warpage or damage to the crosshairs in the field.

Any one of crosshairs 5A–E may be easily removed or inserted by the use of its head 4. The crosshairs are then held in place by inserting fingerscrews 1 through the smooth bore holes 16 of the retaining plate 2 and screwing them into the threaded holes 22 of the entrance wall 3. The use of holes as the method to secure the placement of the crosshairs provides a built-in memory. By making note of the row number and hole number of the crosshairs under a given shooting condition, the sight can be easily reset, even if the sight body 7 has been removed entirely from the bow. This is accomplished by first reattaching the body 7 to the sight plate 28 by use of lock nuts 13 & 14. By loosening and tightening these lock nuts, the entire sight body 7 can be moved up and down along a clearance slot 29 to reset the top range pin 5A. By moving lock nuts 13 & 14 along the threaded rod 12, the sight can be adjusted for windage. Once these two items are completed, the other crosshairs are automatically reset by virtue of being in the same hole positions used previously.

What is claimed:

1. A sight for an archer's bow, comprising:

(a) a rigid sight body member, having elongated side members and a central opening therein;

(b) the elongated side members of which each having a plurality of holes of first diameter found therein, said holes being arranged in vertical rows extending lengthwise down each said side member, said rows being out of vertical registration, one with the other;

(c) a rigid first crosshair bisecting the central opening of said body member through its vertical plane;

(d) a plurality of second crosshairs, each having a diameter slightly less than said first diameter and positioned in said holes of said first diameter;

(e) a retaining member attachable to said sight body member for securing said second crosshairs in place and comprised of two screws and a rigid plate with two holes of substantially smooth bore therethrough and a stepped-down portion to allow clearance for the said second crosshairs;

(f) a mounting mechanism whereby the sight can be attached to an archer's bow.

2. A sight according to claim 1 wherein the mounting mechanism comprises two threaded rods and three sets of nuts and wherein the rods are attached to the body member by means of two threaded holes found in the second side member and secured thereto by means of one said set of nuts, the remaining two sets being used to attach the body member to the bow and, once attached, to move the body member horizontally to adjust for windage.

3. A sight according to claim 2 wherein each of said second crosshairs consists of a shaft portion and a knob or head portion for ease of insertion.

4. A sight according to claim 3 wherein there exists a hole through the top member of said body member to allow for light or attachment of accessory devices.

5. A sight for an archer's bow comprising:

(a) a rigid sight body member, said body member having a longitudinal dimension and a transverse dimension, said body member including a first and a second elongate side member lying along said longitudinal dimension of said body member and being spaced parallel to one another, said first side member having a plurality of smooth bore holes formed therethrough, said holes having a first diameter and being arranged to form a first row and a second row, said rows extending along said longitudinal direction of said body member, said first row being out of vertical registration with said second row, said second side member having a third and fourth row of holes of first diameter extending along said longitudinal direction of said body member, said third row being out of vertical registration with said fourth row, said first and second members having two threaded holes of a second diameter therethrough to allow for the passage of threaded shafts, each said side member having a first and second end, an elongate top member attached to said first ends of said side members and an elongate bottom member attached to said second ends of said side members, said side members and said top and bottom members in assembly defining an aperture;

(b) a first crosshair mounted in said body member, said first wire bisecting the aperture of said body member and arranged parallel to the longitudinal dimension of said body member and perpendicular to said top member and said bottom member of said body member;

(c) a plurality of second crosshairs composed of substantially rigid material capable of supporting its own weight, each of said second crosshairs having a diameter slightly less than said first diameter such that said second crosshairs can pass through any of said plurality of holes with substantial ease, said second crosshairs each comprising a shaft portion and a head portion for the dual purposes of preventing the second crosshairs from passing completely through said holes and to provide ease in handling;

(d) a means for securing the said second crosshairs in place once when inserted in any of the said plurality of holes, said means comprising a plate, said plate being elongated to extended along the longitudinal dimension of said body member and having opposite parallel surfaces, one of said surfaces having a stepped-down portion to provide clearance for the head portion of said second crosshairs, said plate also having two holes of a third diameter therethrough for the passage of screws;

(e) a means for mounting said body member to a standard bow mounting plate such that the said second member of said body member remains parallel to said mounting plate and such that the proximity of said body member to said mounting plate can be easily varied so as to account for windage.

6. A sight according to claim 5 wherein the said third and fourth rows of holes do not fully penetrate the said second side member so as to provide additional support and stability to the said second crosshairs.

7. A sight according to claim 6 wherein the mounting mechanism consists of a set of threaded rods and three sets of nuts, the second side member of the sight body member being equipped with threaded holes to accept said threaded rods.

8. A sight according to claim 7 wherein there exists a hole through the top member of said body member to allow for light or the attachment of an accessory device.

* * * * *